US006022040A

United States Patent [19]

Buzbee

[11] Patent Number: 6,022,040

[45] Date of Patent: Feb. 8, 2000

[54] FREELY ROTATING STEP-IN SNOWBOARD BINDING

[76] Inventor: Douglas C. Buzbee, 3032 Sunset La., Oxnard, Calif. 93035

[21] Appl. No.: 09/064,241

[22] Filed: Apr. 23, 1998

[51] Int. Cl.[7] ..... A63C 9/02

[52] U.S. Cl. ..... 280/613; 280/607; 280/618; 280/14.2; 403/348

[58] Field of Search ..... 403/348, 350; 280/607, 613, 617, 618, 629, 623, 636, 14.2

[56] References Cited

U.S. PATENT DOCUMENTS

| | | | |
|---|---|---|---|
| 4,196,920 | 4/1980 | Salomon | 280/613 |
| 4,973,073 | 11/1990 | Raines et al. | 280/624 |
| 5,028,068 | 7/1991 | Donovan | 280/618 |
| 5,029,890 | 7/1991 | Pfaffenbichler et al. | 280/613 |
| 5,035,398 | 7/1991 | Chiang | 403/348 X |
| 5,261,689 | 11/1993 | Carpenter et al. | 280/618 |
| 5,354,088 | 10/1994 | Vetter et al. | 280/14.2 X |
| 5,409,244 | 4/1995 | Young | 280/14.2 |
| 5,499,837 | 3/1996 | Hale et al. | 280/607 |
| 5,520,405 | 5/1996 | Bourke | 280/14.2 X |
| 5,520,406 | 5/1996 | Anderson et al. | 280/624 |
| 5,553,883 | 9/1996 | Erb | 280/607 |
| 5,556,123 | 9/1996 | Fournier | 280/607 |
| 5,906,388 | 5/1999 | Neiley | 280/613 |
| 5,913,530 | 6/1999 | Berger et al. | 280/14.2 X |

OTHER PUBLICATIONS

*Snowboarder* Magazine Unknown "Clicker" Binding Nov. 1997.

*Snowboarding* Mag. Unknown "Arcane" Binding Nov. 1997.

*Snowboarder* Mag. "Flytrap" Binding 1997 Unknown.

*Primary Examiner*—Michael Mar

[57] ABSTRACT

An improved snowboard binding system allows the snowboarder to maintain full control of the snowboard while also allowing the snowboarder to rotate the feet during the operation of the snowboard without the requirement of manual adjustment. A binding base (22) is attached to the snowboard and contains a circular, downward-facing surface (23) having several discontinuities. A boot catch structure (26) is attached to the user's boot and has a corresponding number of upward facing planar surfaces (27) that fit into the base surface discontinuities. Engagement of the binding is accomplished by the insertion of the boot catch into the binding base and relative rotation of the two parts. The binding system is equipped with a locking plate (24) that guards against accidental release of the binding system.

4 Claims, 5 Drawing Sheets

FREELY ROTATING STEP-IN SNOWBOARD BINDING

BACKGROUND

1. Field of the Invention

This invention relates to the field of snowboarding. Specifically, it relates to a snowboard binding system that allows the snowboarder to step directly into the binding, and that allows limited rotational movement of the feet after engagement of the binding and during operation of the snowboard, all without manual operation.

2. Snowboarding and Its Problems

Snowboarding is essentially wave surfing applied to down-hill skiing terrain and conditions. While the skier uses one long plank attached to each foot to glide downhill over the snow, the snowboarder attaches both feet transversely to one shorter, wider plank with which she glides over the snow. The motion of snowboarding is much more similar to surfing than to skiing.

Snowboarding has grown in popularity over the past decade or so, to the point that it is becoming almost as popular as skiing. In fact, with younger generations of ski resort clients, snowboarding is already more broadly undertaken, which suggests that it will be more prevalent on the ski slopes in the foreseeable future.

Snowboarding requires a binding system that maintains both feet securely attached to the snowboard at all times during operation. Furthermore, the bindings must keep the feet from rotating or swiveling relative the snowboard during the operation of turning the snowboard, or while maneuvering through a turn. These requirements have led to the present array of commercially available snowboard bindings, all of which maintain both feet rotationally secure to the board at all times while the feet are attached.

There are two general types of snowboard bindings revealed in the prior art and commercially available today, (1) the soft boot binding, and (2) the step-in binding. Soft boot bindings evolved first and are used in conjunction with a basically normal winter snow boot. These bindings usually require snowboarders to sit in the snow while strapping their boots into the bindings. Examples can be seen in U.S. Pats. Nos. 5,261,689 to Carpenter (1993); 5,409,244 to Young (1995); and 5,556,123 to Fournier (1996), among others.

Step-in bindings require the use of a special boot specifically adapted to its specific binding. These bindings allow the snowboarder to step in and out of the binding faster and with greater ease. Examples of step-in bindings can be seen in U.S. Pats. Nos. 5,520,406 to Anderson (1996) and 4,973,073 to Raines (1990), among others.

All snowboard bindings of the prior art of which I am aware maintain the feet rotationally secure to the board at all times while the feet are attached. This presents problems that have not been solved in the prior art:

Problem 1. When a snowboarder reaches the end of a run, he must propel himself through the lift line through an action known as skating. Skating consists of manually releasing the rear foot binding, and propelling oneself with the rear foot while the front foot remains attached, much like the action of a skateboarder propelling himself along a horizontal street. With the currently available step-in snowboard bindings, none of which allow the free rotation of the front foot, the snowboarder's front foot remains cocked at an unnatural angle during skating.

This situation often causes snowboarders to collide with other skiers and snowboarders in a lift line (the lift conveys the skier up the mountain) because of poor control of the snowboard under these awkward conditions.

Problem 2. A related problem presents itself during the ride up the mountain on the ski lift. A skier can sit in the chair lift with skis pointing straight ahead, not intruding into the adjacent space occupied by another passenger. The snowboard user, however, with the feet set at an angle to the board's central axis, must cock the board so that it intrudes into the space occupied by the adjacent passenger. To avoid this intrusion, the snowboarder must straighten the board with feet pointed straight ahead, which places severe stress on the user's ankle and knee.

There is considerable strain put on the knee due to the moment applied to it from the asymmetrical weight of the snowboard being transferred to the knee through the moment-resisting connection of the single foot to the snowboard. Even without the problem of an adjacent skier or snowboarder, and provided ample room to allow the snowboard to lie sideways during the trip up the chair lift, the strain upon the snowboarder's knee should not have to be endured as a part of the sport.

Problem 3. Most snowboarders ride with the front and rear feet at different angles to the longitudinal axis of the snowboard. For example, the front foot is 40 degrees to the long axis of the snowboard and the rear foot is 90 degrees to the long axis of the snowboard. However, many snowboarders ride freestyle throughout which the direction of movement constantly changes; the snowboarder and snowboard are turned 180 degrees in mid flight. In other words, the front foot becomes the rear foot and vice-versa. This riding situation is known as riding faky.

Riding faky results in undesirable respective angles of the front and rear feet to the longitudinal axis of the snowboard. Using the example from above, the front foot is now 90 degrees to longitude and the rear foot is positioned 140 degrees to longitude. This situation decreases overall control of the snowboard and places undue stress upon the rider's ankles and knees.

Likewise, freestyle snowboarders frequently perform aerial jumps and tricks which contort and twist the body in general. Currently available snowboard bindings, which maintain both feet rotationally secure during these maneuvers, restrict the snowboarder's motion and may put undue stress on the rider's joints.

PRIOR ART

Various step-in bindings currently exist, such as disclosed in U.S. Pat. No. 5,520,406 to Anderson et al. (1996), U.S. Pat. No. 4,973,073 to Raines et al. (1990), the commercially available Clickerstep-in binding (advertised in *Snowboarder* magazine, November 1997), and the commercially available Arcane binding system (advertised in *Snowboarding* Magazine, November 1997).

Problems 1 and 2 above have been recognized in previous patents but have not been satisfactorily solved. Donovan addressed these in his U.S. Pat No. 5,028,068 (1991). However, his binding requires manual operation to change the angular positioning of the feet and therefore fails to allow the snowboarder to rotate the feet during operation of the snowboard. Likewise, Hale and Whyte recognized similar problems in U.S. Pat No. 5,499,837 (1996). However their binding fails for the same reasons that Donovan's does; it requires a manual adjustment to rotate the foot.

Problems 1, 2, and 3 have been addressed by a binding commercially available and advertised in *Snowboarder* magazine (Spring 1997 issue) manufactured by Flytrap Advanced Bindings of 6304 Sixth Avenue, Tacoma, Wash. 98406. However, these bindings do not satisfactorily resolve these problems for the following three reasons: (1) Once the foot is released from the board, the soft boot support remains attached to the boot and this hinders walking and skating. In fact, the manufacturer warns against walking with the binding attached to the boot; (2) Traction is greatly compromised by the smooth bottom surface of the binding which is in contact with the snow during the skating operation; (3) Most importantly, rotation of the foot during operation requires manual operation in the use of a leash (a cord attached to the binding and held in the hand). Furthermore, these bindings are for soft boot binding applications only.

Insofar as I am aware, no other prior approaches successfully resolve the three problems above, let alone their combination.

OBJECTS AND ADVANTAGES OF THE INVENTION

Accordingly, one object and advantage is to provide an improved snowboard binding system.

A second object of this invention is to provide a snowboard binding system that allows the snowboarder to rotate the front foot without requirement of manual operation.

A third object and advantage is to provide a snowboard binding system that allows the snowboarder to place the front foot along the long axis of the snowboard (longitudinally) after having reached the end of the run and having entered the lift line. This action is much like a skateboarder placing the front foot longitudinally along the skateboard during the action of propelling the skateboard with the rear foot.

A fourth object is to provide a snowboard binding that allows the snowboarder to ride a ski lift comfortably without intruding into a neighbor's space on the lift chair.

A fifth and important object is to allow the snowboarder riding freestyle to continually change the rotational positioning of the feet during operation of the snowboard without manual operation. This will allow the snowboarder to ride faky and to perform aerial maneuvers with greater comfort, flexibility and control.

Other objects are:

(6) to provide a snowboard binding that will remain engaged until it is manually disengaged by the user;

(7) to provide a binding that meets objectives 1, 2, 3, 4, and 5 above in a step-in type configuration which allows the snowboarder to engage the binding system easily without requirement of manual operation, and to disengage the system manually and easily;

(8) to provide a snowboard binding system that is safe to use under all normal snowboarding conditions;

(9) to provide a binding system that is of simple design and construction, thereby lending itself to ease of manufacture, reliability and effectiveness of function; and

(10) to provide a snowboard binding compatible with existing binding mountings so that the embodiment will be adaptable and readily and easily adopted by snowboarders who already own snowboards. This will improve the commercial viability of the binding.

Further objects and advantages will become apparent from the following drawings and detailed description.

SUMMARY OF THE INVENTION

My snowboard binding is a step-in type snowboard binding that is comprised of a binding base, flanges or other structure on the binding base that provide a downward-facing circular planar surface, a snowboard boot, a catch structure on the snowboard boot that provides an upward facing planar surface, interlocking radial ridges on the binding base and on the boot catch structure, and a locking plate to guard against accidental release of the binding. This combination leads to an operable binding system that allows free rotation of the feet under certain circumstances and rotational security of the feet under others, and thus provides the snowboarder with heretofore unknown control, flexibility, comfort, and safety.

REFERENCE NUMERALS IN DRAWINGS

Figure 1:
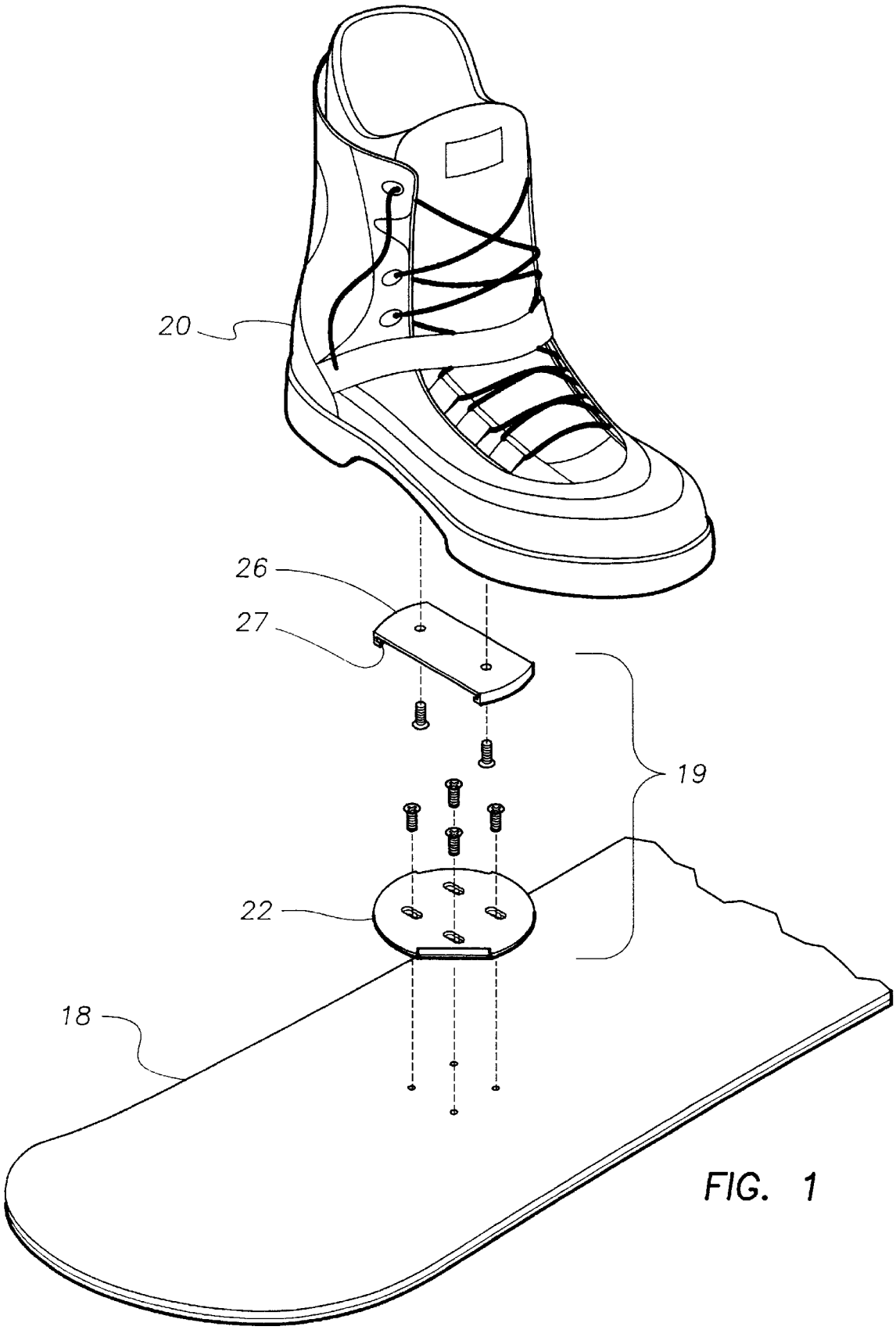
FIG. 1 is an exploded perspective view of a snowboard binding system according to the invention also showing the snowboard and a device for attaching the snowboard binding system.

18 snowboard
19 assembled binding system
20 snowboard boot
22 binding base
23 binding base flanges
24 locking plate
25 spring
26 catch structure
27 catch structure flanges
28 interlocking radial ridges

FIGS. 1–4—DESCRIPTION OF THE PREFERRED EMBODIMENT

FIG. 1 is an expanded view of a preferred binding assembly 19. A circular binding base 22 is secured to a snowboard 18 via several screw receiving holes in base 22. A four-hole pattern is illustrated in these figures which is compatible with many presently available snowboards. A boot catch structure 26 is secured to a boot 20 via two screw receiving holes in the boot 20.

Figure 2:
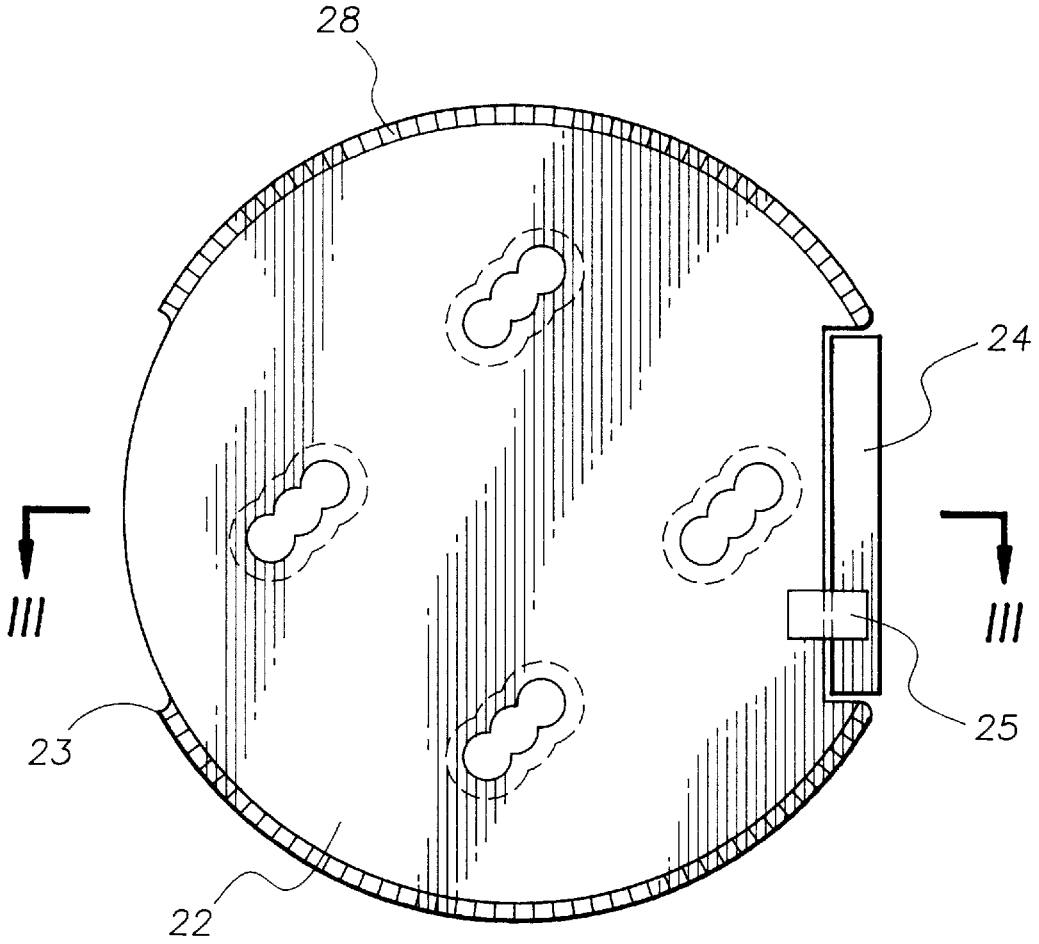
FIG. 2 is a bottom plan view of a binding base according to my invention with flanges and locking plate used to keep the binding system engaged unless manually released.

FIG. 2 is a bottom plan view of binding base 22 which is comprised of a circular disk with two opposing binding base flanges 23 projecting from the disk, each having the same arc length, and being opposite each other (symmetrical). Flanges 23 have ridges 28 placed radially along the underside of flange 23. A locking plate 24 is placed between one of the spaces between the flanges. Plate 24 consists of a small flat piece of rigid material (e.g., steel) attached to base 22 via a hinge and equipped with a spring 25 to maintain plate 24 in the more or less horizontal position unless manually depressed. Plate 24, spring 25, snowboard 18, and binding base 22 can be viewed together in FIG. 3, which is a cross-section indicated by line III—III in FIG. 2.

Figure 4:
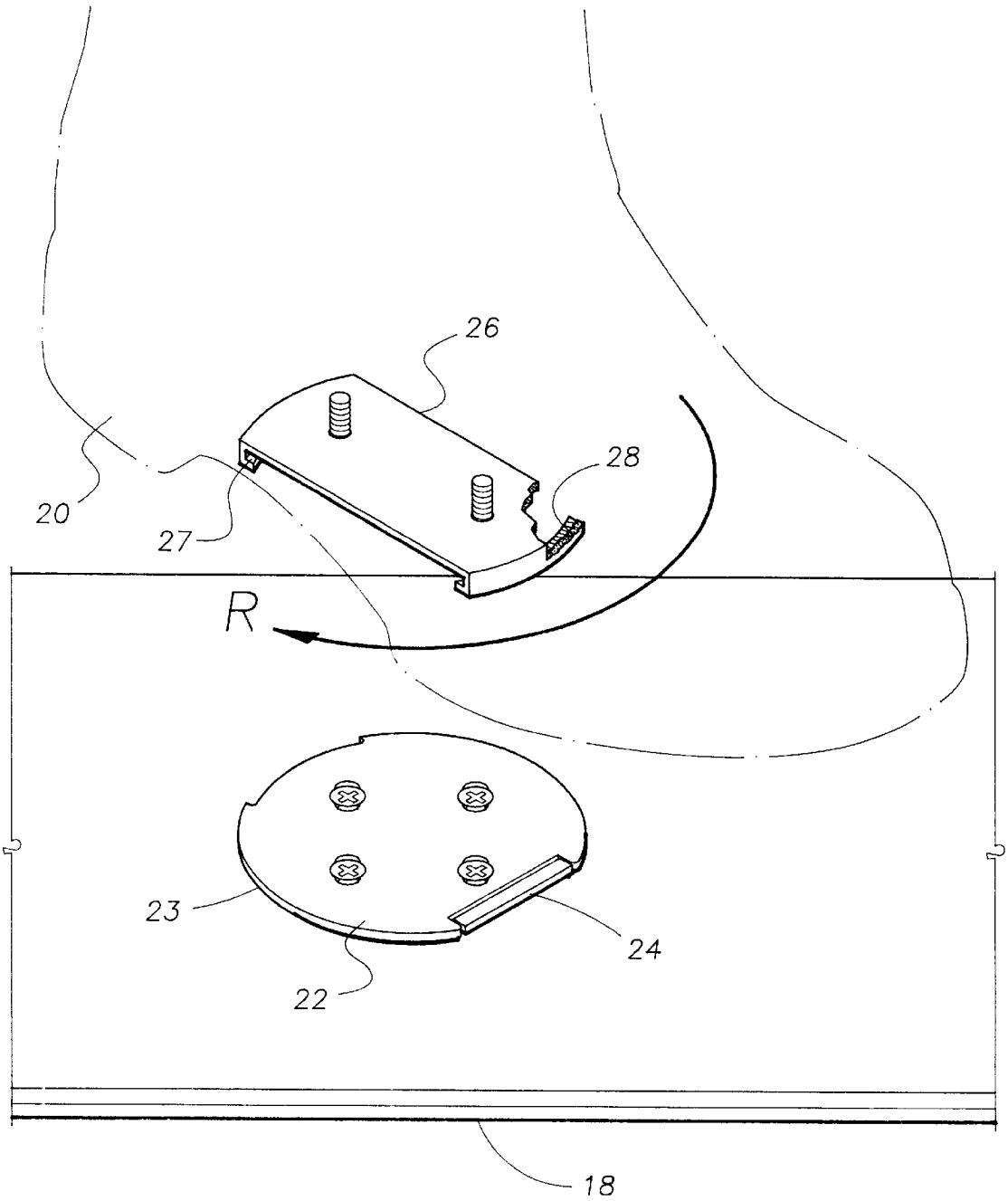
FIG. 4 is an exploded perspective view of a snowboard boot equipped with a catch structure and base plate according to my invention.

FIG. 4 shows boot 20 and catch structure 26 as the snowboarder is stepping into the binding. Catch structure 26 has two flanges 27 placed at either end that engage binding base flanges 23 upon rotation of boot 20. Catch structure flanges 27 are equipped with interlocking radial ridges 28 on their upper surfaces. Catch structure 26 must be large enough to encompass binding base 22 upon relative rotation of the two components. In other words, the inside distance between the vertical portions of catch structure flanges 27 must be greater than the outside diameter of binding base 22 including binding base flanges 23. The boot mounted catch structure flanges 27 must be narrower than the space between binding base flanges 23. Catch structure 26 is bolted or otherwise attached to boot 20. Catch structure 26 is placed on the bottom of boot 20 with its two opposing flanges 27 placed toward the toe and the heel of boot 20.

Figure 5:
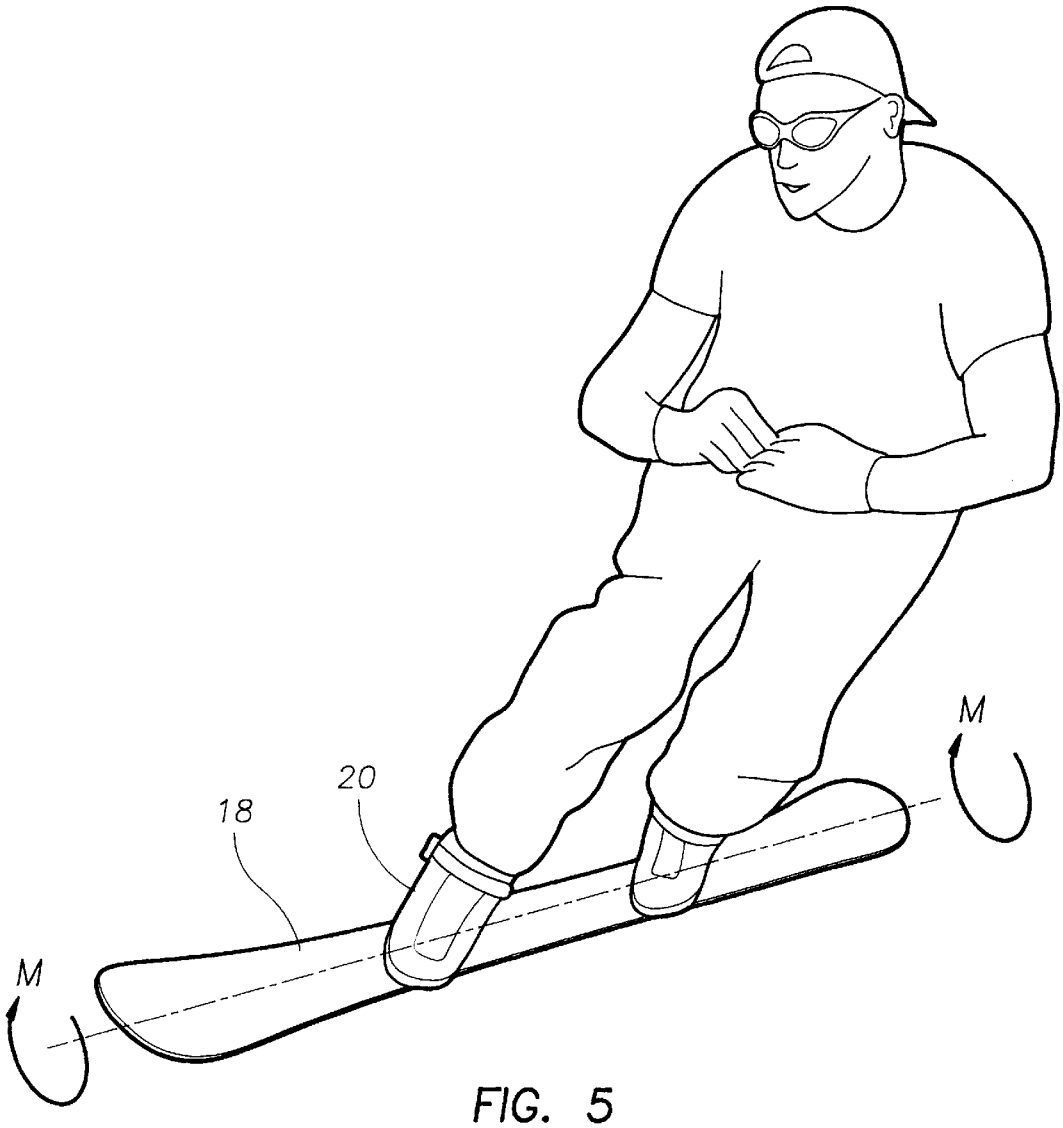
FIG. 5 is a perspective view of a snowboarder maneuvering through a turn on a snowboard equipped with my bindings.

FIG. 5—Operation of Snowboard

The snowboarder turns the snowboard by putting weight on the toes or on the heels. This action causes the curved edge of the board to form a curved line in the snow and ultimately turns the snowboard. To go straight, the snowboarder maintains her weight on the middle of the foot, allowing the board to glide on its lower flat surface without allowing any of the board's edges to form a contact line in the snow.

FIG. 5 is a perspective view of a snowboarder maneuvering through a turn on a snowboard 18 equipped with my binding assemblies 19 (not seen in figure). In order to accomplish the turn, the snowboarder is leaning forward, placing all weight on the front edge of the board, causing the slightly curved board edge to form a curved intersection with the snow surface, and thus causing the board to turn. This figure shows how a moment M is applied to the board through the binding during a turn. Because of the applied moment, applied pressure and ultimately friction are increased between interlocking radial ridges 28, and the bottom of boot 20 (in this case the toe of the boot) and the top surface of snowboard 18. This increased friction maintains the foot stable and prohibits rotation of the foot throughout the turn and thus allows the snowboarder to maintain control of the snowboard.

Figure 3:
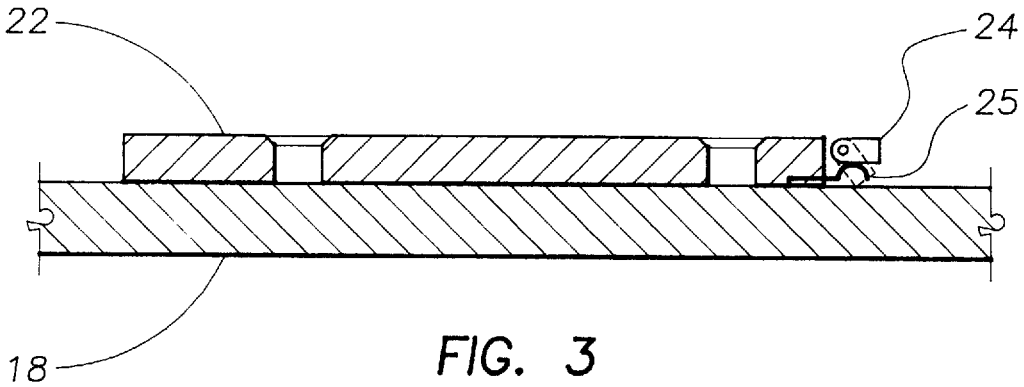
FIG. 3 is a cross section of the binding base indicated by line III—III in FIG. 2.

FIGS. 3, 4, 6, AND 7—Operation of the Freely Rotating Step-In Snowboard Binding FIG. 3 shows a cross section of the binding base 22 and the locking plate 24 indicated by line III—III in FIG. 2 and more clearly depicts the operation of locking plate 24 and catch structure flanges 27. Spring 25 maintains the locking plate in the path of catch structure 26. When binding assembly 19 is first engaged, locking plate 24 is depressed automatically by engaging catch structure 26 (specifically, by catch structure flange 27). As boot 20 is rotated to engage binding base flanges 23, locking plate 24 is released and returned to its original upright position, interrupting the path of engaging catch structure 26. In its upright position, locking plate 24 prevents boot 20 from rotating back to the engaging position and this keeps binding assembly 19 from accidentally disengaging. Binding assembly 19 may be disengaged intentionally by manually depressing locking plate 24, thus removing it from the path of boot binding catch structure 26, and rotating boot 20 until catch structure 26 no longer engages base flanges 23.

FIG. 4 shows the how binding assembly 19 is engaged. Boot 20 is placed on binding base 22 such that catch structure flanges 27 are positioned directly over the spaces between binding base flanges 23. During this action, locking plate 24 is depressed by catch structure flange 27, which allows boot 20 and binding base 22 to rotate relative each other. This allows the engagement of catch structure flanges 27 and binding base flanges 23. Boot 20 is rotated in either direction (in this figure clockwise as indicated by arrow "R"), during which catch structure flanges 27 slide beneath binding base flanges 23 and beyond the locking plate 24, allowing locking plate 24 to return to its upright position, and thus locking binding assembly 19 in the engaged position. The engagement of binding assembly 19 takes place precisely between binding base flanges 23 and catch structure flanges 27.

Figure 6:
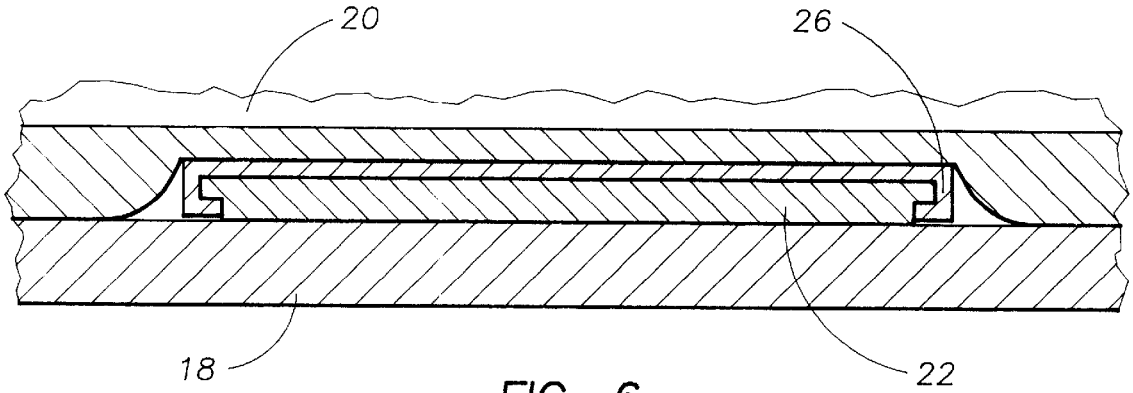
FIG. 6 is a longitudinal (with regard to the boot) cross section of the binding system in the engaged position and the snowboard.

FIG. 6 shows the interaction of binding base 22, binding base flanges 23, catch structure 26, and catch structure flanges 27 when binding assembly 19 is in the engaged position. This occurs after boot 20 has been rotated beyond the engaging position shown in FIG. 4.

Figure 7:
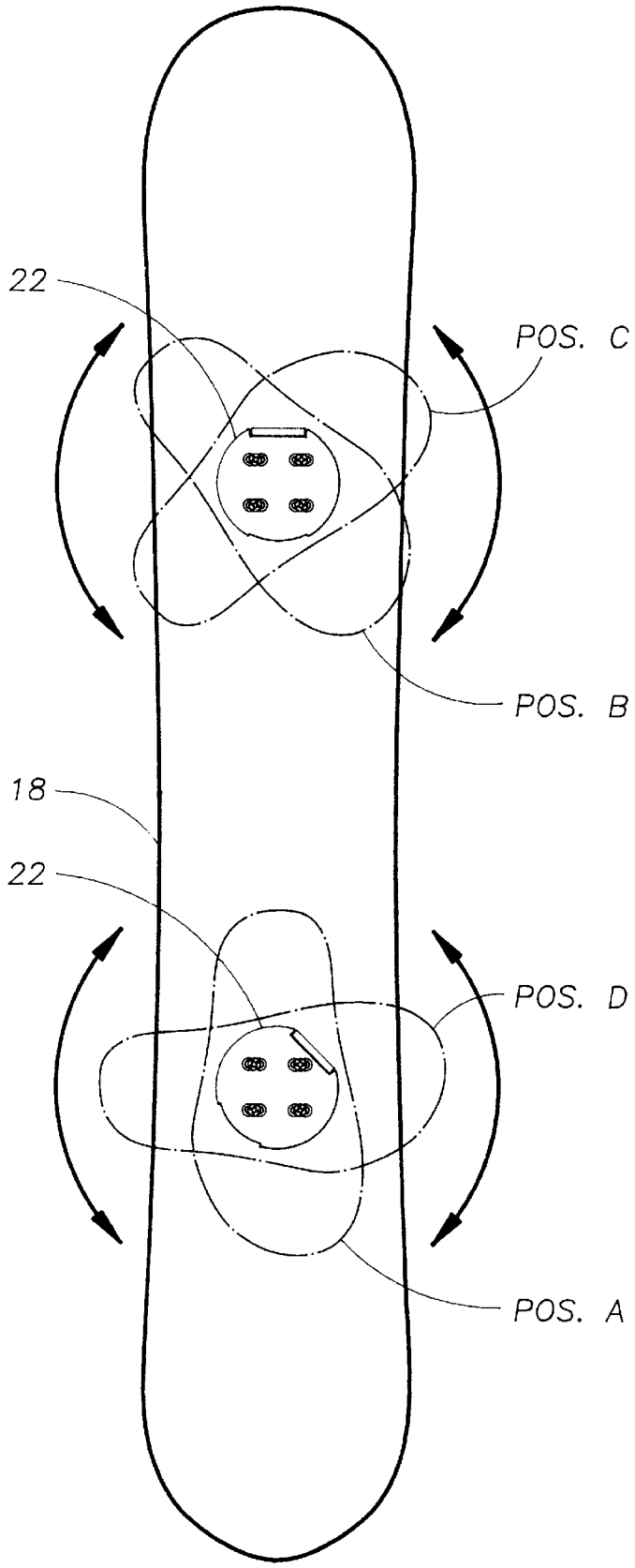
FIG. 7 is a plan view of a snowboard fitted with my bindings.

FIG. 7 shows the limited free rotation of the foot while binding assembly 19 is engaged and when no moment is applied to the snowboard 18 via the binding assemblies 19. This freedom of rotation during operation of the snowboard allows greater flexibility and resolves problems discussed and not resolved by the prior art. The orientation of the binding base 22 may be different for each foot to accommodate the snowboarder's preferred stance. Different orientations of each binding base 22 are shown in FIG. 7 which result in different ranges of foot positions for each of the snowboarder's two feet.

POS A represents a likely position of the front foot while the snowboarder is moving through the lift line or otherwise skating (direction of movement is downward in this figure). POS B represents a likely position of the rear foot while the snowboarder is snowboarding with the preferred front foot forward (direction of movement is downward in this figure). POS C represents a likely position of the rear foot while the snowboarder is snowboarding with the rear foot forward and the preferred front foot behind, or riding faky (direction of movement in upward in this figure). POS D is a likely position of the preferred front foot while the snowboarder is riding faky (direction of movement is upward in this figure).

The positions shown in FIG. 7 are approximate limits of the free rotation of the feet while the binding system is engaged. The snowboarder may choose any stance for any given situation within the limits shown, and will likely change stance many times during the course of any run.

FIG. 5—Physics of Turning a Snowboard

When the snowboarder turns, a moment is applied to the snowboard. This is indicated by "M" in FIG. 5. Friction occurs between the bottom of boot 20 and the upper surface of snowboard 18. Friction is also created by the interlocking of radial ridges 28 on catch structure flanges 27 and binding base flanges 23. This resists rotational movement of the feet and enables the snowboarder to control the snowboard. When the snowboarder is standing upright, e.g. in the lift line or traveling straight, the boot may be raised just enough from the snowboard to allow the rotation of the foot. This allows the snowboarder to rotate the feet in mid-flight while snowboarding and to adjust the front foot while skating without manual operation. It also provides the snowboarder comfort while riding the chair lift by being able to adjust the board to a comfortable angle on the foot. None of these three new results have been successfully achieved in any prior-art snowboard.

SUMMARY, RAMIFICATIONS, AND SCOPE

The reader will see that snowboard binding of the invention provides a fully functional and safe device for snowboarding that allows the snowboarder to maintain effective control but also allows the snowboarder to move comfortably through the lift line, ride comfortably on the chair lift, and most importantly change the position of the feet in mid flight. This is all accomplished without the requirement of manual operation due to the free rotatability of the feet while attached to the snowboard.

Although the above specification is detailed and the drawings are specific, anyone skilled in the art will appreciate that many possible variations, additions, and modifications are possible without departing from the scope and spirit of the invention. For example, the locking plate can be attached to the boot catch as opposed to the base plate; the boot catch can be an integral component of the boot construction as opposed to an attached element; the boot catch can comprise three or more flanges instead of two; the base can have three or more flanges and corresponding boot catch receiving slots; the base can be attached via means of a hold down plate, as opposed to being directly attached, et cetera. The materials, dimensions, shapes and attachments of the components can be changed from the specific versions shown.

Therefore, the scope of the invention should not be determined by the embodiments illustrated and described, but by the appended claims and their legal equivalents.

I claim:

1. A snowboard binding system for releasably attaching a boot of a user to a snowboard, comprising:

a circular base plate having a bottom surface adapted to be fixedly attached to an upper surface of the snowboard, the base plate having a circumferential edge formed by a pair of opposed flange portions separated by first and second opposed recessed portions, the flange portions being arc-shaped and having radius of curvatures which are equal, the first recessed portion having an arcuate edge with a radius of curvature which is less than the radius of curvature of the flange portions, the flange portions having lower surfaces which are elevated relative to the bottom surface of the base plate;

an attachment plate having a planar portion adapted to be fixedly attached to a bottom surface of the boot, a pair of end walls extending downwardly from opposite ends of the planar portion, the end walls being arc-shaped and having a pair of inwardly extending arc-shaped segments formed on lower ends of the end walls, each end wall having an inner surface with a radius of curvature substantially equal to the radius of curvature of the flange portions, the inner surfaces of the end walls being spaced apart a greater distance than a distance between the outer circumferential edges of the pair of flange portions for permitting relative rotation therebetween when the attachment plate is attached to the base plate, the arc-shaped segments having upper surfaces with locking portions selectively engageable with locking portions on the lower surfaces of the flange portions for releasably locking the boot at a selected angular position of adjustment relative to the base plate; and a locking assembly including a locking plate having an inner portion received within the second recessed portion of the base plate and pivotally attached thereto for movement of the locking plate between an elevated locking position and a downwardly extending release position, and a spring attached to the base plate for biasing the locking plate to the locking position, the locking plate permitting a limited range of pivotal movement of the attachment plate relative to the base plate while in the locking position and permitting rotation of the attachment plate to a position wherein the arc-shaped segments can pass through the first and second recessed portions for release of the attachment plate from the base plate when the locking plate has been moved to the release position.

2. A snowboard binding system according to claim 1, wherein the locking portions on the upper surfaces of the pair of arc-shaped segments and the locking portions on the lower surfaces of the pair of flange portions include a plurality of radial interlocking ridges for releasably locking the boot in the selected angular position of adjustment relative to the base plate.

3. A method of using a snowboard binding system for releasably attaching a boot of a user to a snowboard, the binding system including:

a circular base plate having a bottom surface adapted to be fixedly attached to an upper surface of the snowboard, the base plate having a circumferential edge formed by a pair of opposed flange portions separated by first and second opposed recessed portions, the flange portions being arc-shaped and having radius of curvatures which are equal, the first recessed portion having an arcuate edge with a radius of curvature which is less than the radius of curvature of the flange portions, the flange portions having lower surfaces which are elevated relative to the bottom surface of the base plate;

an attachment plate having a planar portion adapted to be fixedly attached to a bottom surface of the boot, a pair of end walls extending downwardly from opposite ends of the planar portion, the end walls being arc-shaped and having a pair of inwardly extending arc-shaped segments formed on lower ends of the end walls, each end wall having an inner surface with a radius of curvature substantially equal to the radius of curvature of the flange portions, the inner surfaces of the end walls being spaced apart a greater distance than a distance between the outer circumferential edges of the pair of flange portions for permitting relative rotation therebetween when the attachment plate is attached to the base plate, the arc-shaped segments having upper surfaces with locking portions selectively engageable with locking portions on the lower surfaces of the flange portions; and a locking assembly including a locking plate having an inner portion received within the second recessed portion of the base plate and pivotally attached thereto for movement of the locking plate between an elevated locking position and a downwardly extending release position, and a spring attached to the base plate for biasing the locking plate to the locking position, the method of using the snowboard binding system comprising the steps of:

(a) positioning the pair of arc-shaped segments above the first and second recessed portions of the base plate;

(b) lowering the pair of arc-shaped segments into the first and second recessed portions of the base plate, the locking plate being pivoted to the release position upon engagement with a respective one of the arc-shaped segments;

(c) rotating the attachment plate until the arc-shaped segments are positioned below the flange portions for attaching the boot to the base plate;

(d) rotating the attachment plate to a desired angular position of adjustment relative to the base plate; and (e) forcing the radial ridges on at least one of the arc-shaped segments into interlocking engagement with the radial ridges on the flange portions by movement of the boot relative to the snowboard for locking the attachment plate in a selected angular position of adjustment relative to the base plate.

4. A method of using a snowboard binding system according to claim 3, further comprising the steps of:

(a) pivoting the locking plate to the release position; and (b) rotating the attachment plate relative to the base plate to a position wherein the arc-shaped segments can pass through the first and second recessed portions for releasing the attachment plate from the base plate.

* * * * *